United States Patent [19]

Cabaraux

[11] B 4,013,536

[45] Mar. 22, 1977

[54] ELECTROLYTIC CELL

[75] Inventor: Emile Cabaraux, Brussels, Belgium

[73] Assignee: Solvay & Cie, Belgium

[22] Filed: Jan. 20, 1975

[21] Appl. No.: 542,258

[44] Published under the second Trial Voluntary Protest Program on March 23, 1976 as document No. B 542,258.

[30] Foreign Application Priority Data

Feb. 6, 1974 Belgium ..... 140615

[52] U.S. Cl. ..... 204/252; 204/266; 204/279

[51] Int. Cl.[2] ..... B01K 3/10; C22D 1/02

[58] Field of Search ..... 204/242, 252, 266, 279; 277/229; 23/289, 290, 291, 292

[56] References Cited

UNITED STATES PATENTS

| | | | |
|---|---|---|---|
| 3,030,295 | 4/1962 | LaBarge | 204/242 |
| 3,390,072 | 6/1968 | Wiseman | 204/266 |
| 3,591,483 | 7/1971 | Loftfield et al. | 204/252 |
| 3,632,497 | 1/1972 | Leduc | 204/266 X |
| 3,857,775 | 12/1974 | Custer et al. | 204/266 X |
| 3,869,375 | 3/1975 | Ono et al. | 204/279 X |

FOREIGN PATENTS OR APPLICATIONS

| | | | |
|---|---|---|---|
| 1,124,317 | 8/1968 | United Kingdom | 204/242 |

*Primary Examiner*—G. L. Kaplan
*Assistant Examiner*—A. C. Prescott
*Attorney, Agent, or Firm*—Robert E. Burns; Emmanuel J. Lobato; Bruce L. Adams

[57] ABSTRACT

An electrolytic cell having a base or bottom wall on which are supported sidewalls enclosing the anodes and cathodes within. A seal is constructed between the sidewalls and bottom wall and on which the sidewalls rest. The seal is constructed as a framework of flat bars of rectangular cross section made of rigid material encased in an envelope made of a resilient material having a U-shaped cross section. The envelope is closed on a portion facing into the interior of the cell and its two side legs are held between the framework and the sidewalls and between the sidewalls and the bottom wall respectively.

10 Claims, 2 Drawing Figures

ELECTROLYTIC CELL

BACKGROUND OF THE INVENTION

The present invention relates to improvements of from cells for the electrolysis of aqueous solutions of alkali metal chlorides and diaphragm cells for the manufacture of chlorine.

The invention relates more particularly to an electrolytic cell comprising, above a base wall, an operating sequence of substantially vertical and parallel anodes and cathodes, enclosed by a peripheral side wall, which rests on the base wall with interposition of a sealing joint.

In cells of this type, the sealing joint opposed between the base wall and the peripheral side wall is strongly acted upon by the large hydrostatic pressure, the high temperature and the very corrosive nature of the electrolyte. It is also subjected to stresses of intense mechanical nature under the effect of the generally very different expansions of the base wall and the peripheral side wall during the operation of the cell.

The joints used heretofore in known cells usually consist of a strip of flexible material, for example of rubber or of mastic on an asphalt base, squeezed under a large pressure between the base wall and the peripheral side wall. In order to obtain sufficient squeezing pressure it is necessary to use joints of small sections or to employ clamping frames. In service, highly compressed joints deteriorate rapidly and rarely ensure effective and lasting sealings. Deterioration of their effectiveness is also accelerated by variations occuring in the conditions of electrolysis. Thus at times local leakage of electrolytes is found to start up following a large and sudden fall in the intensity of the electrolysing current.

A deficiency in sealing of the joint is particularly objectionable in the case of cells where the base wall and the peripheral side wall are both made of metal, since there is a risk that it will lead to the setting up of an intense parasitic electric current between these two walls along the joint.

SUMMARY OF THE INVENTION

The present invention overcomes the disadvantages of known cells.

According to the present invention therefore, there is provided a cell for the electrolysis of an aqueous solution of alkali metal halide, comprising, above a base wall, an alternating sequence of substantially vertical and parallel anodes and cathodes, enclosed by a peripheral side wall, which rests on the base wall with interposition of a sealing joint, wherein the sealing joint comprises a rigid framework which surrounds the anodes and cathodes and which is inserted in an envelope made of a material which is resistant to corrosion and has a hardness on the Shore 'A' Scale between substantially 2 and 20, the envelope covering at least that part of the framework that faces towards the interior of the cell and being inserted between the framework and each of the walls.

In the cell according to the invention, the sealing between the base wall and the peripheral side wall is effective, durable and independent of the conditions of electrolysis, particularly of fluctuations in the electrolysing current.

Furthermore, in the cell according to the invention effective sealing between the base wall and the peripheral side wall is obtained without the need to squeeze the joints under high pressure between these two walls. This results in less stress of the joints and an improvement in the requirements for assembly and maintenance of the cell according to the invention.

In the cell according to the invention, the framework of the joint may be made of any rigid material, for example cast iron or steel.

In a preferred embodiment of the cell according to the invention, the framework of the joint is made of a material resistant to corrosion, for example of reinforced polyester, and the envelope is made of a material that has a cellular structure. The envelope material is preferably an ethylenepropylene copolymer for example the material DUTRAL (a trademark of Montecatini).

BRIEF DESCRIPTION OF THE DRAWINGS

Further features and details of the invention will be apparent from the following description of the accompanying drawings, which represent, by way of example one particular embodiment of the cell according to the invention.

DESCRIPTION OF THE PREFERRED EMBODIMENTS

Figure 1:
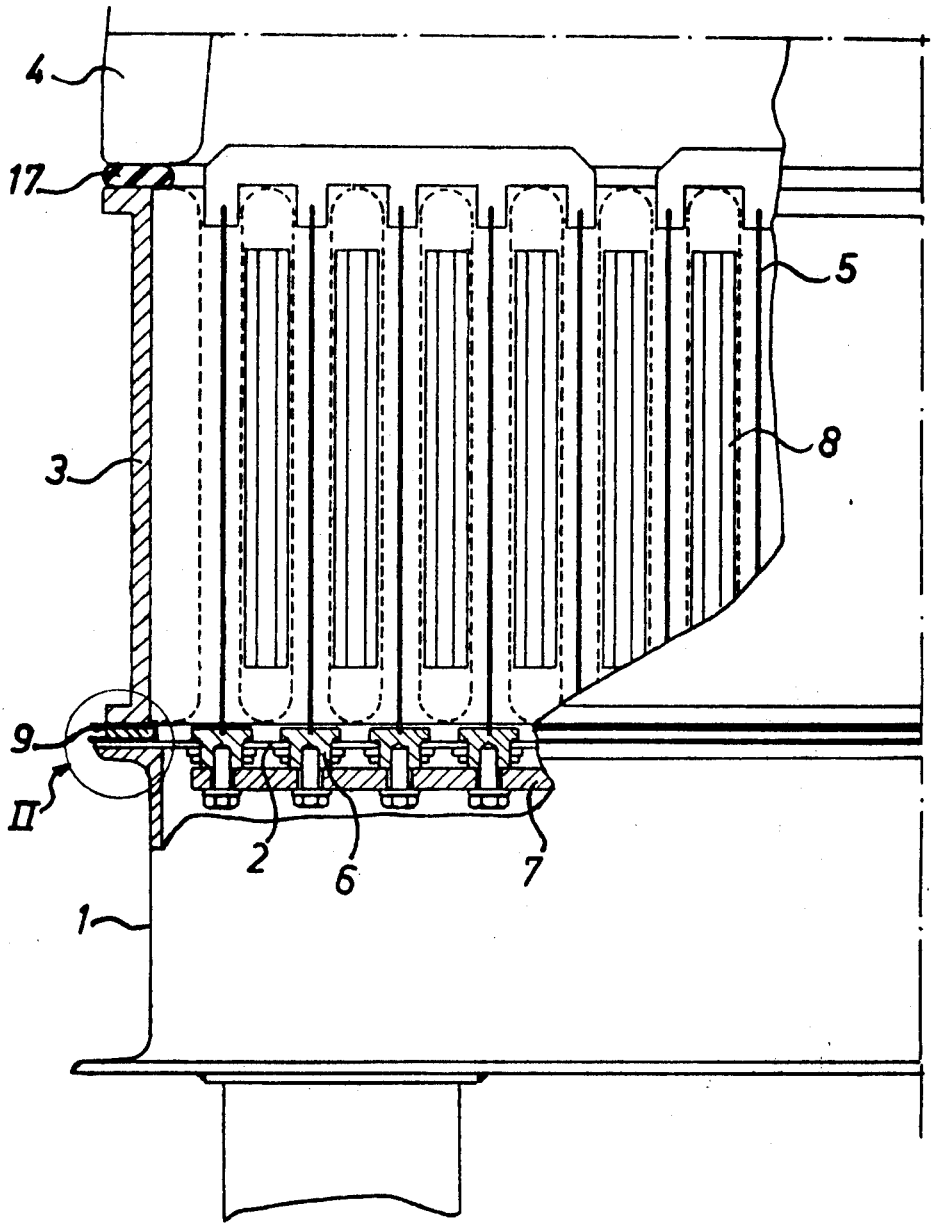
FIG. 1 of the accompanying drawings shows in elevation, partially cut away, an embodiment of a cell according to the invention.

In FIG. 1 is shown a monopolar diaphragm cell of the type taught in Belgium Pat. No. 136867 in the name of the present applicants, and particularly suited to the production of chlorine by the electrolysis of an aqueous solution of sodium chloride.

The cell comprises, from a foundation 1, a base plate 2 of titanium, which supports at its periphery a lateral side wall 3 of steel, which is surmounted by a cover 4. Metal anodes 5, substantially vertical and parallel, are supported above the base plate 2 by anode support 6 made of titanium, which pass through the base plate 2 and are connected to current lead-in bars 7.

The anodes 5 alternate with cathodes 8, which are covered by a diaphragm (not shown) and are fixed to the side wall 3. Sealing between the base wall 2 and the side wall 3 is ensured by a joint interposed between these two walls and indicated as a complete assembly by reference 9.

Figure 2:
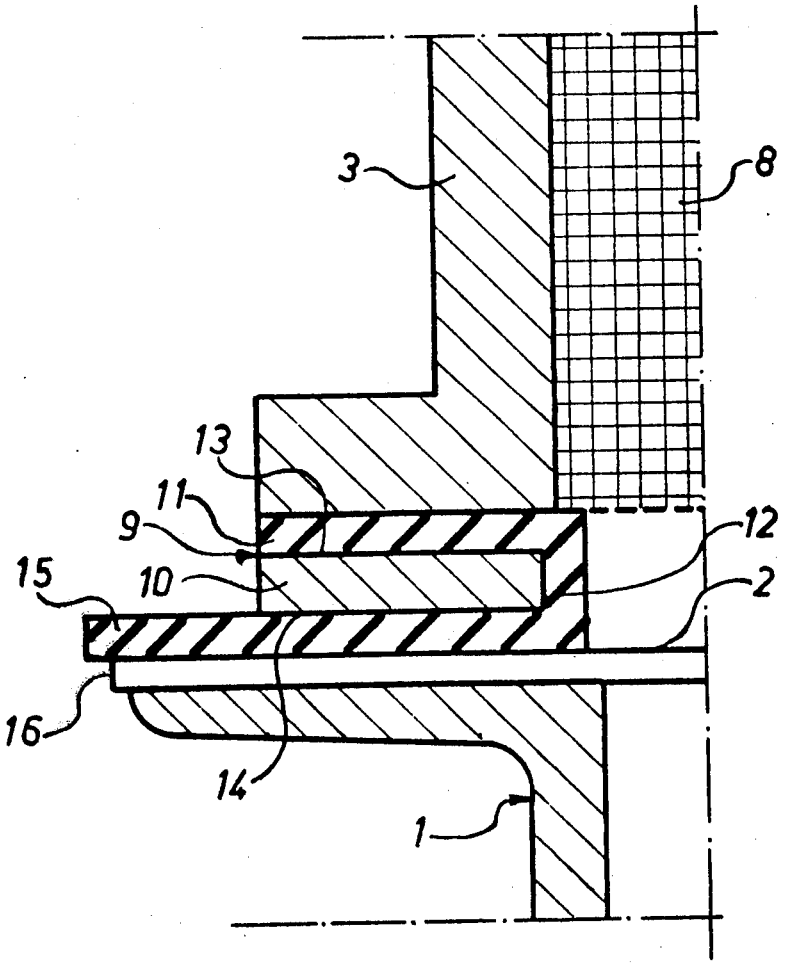
FIG. 2 shows on a larger scale, the details II of FIG. 1. In these figures like parts are numbered alike.

According to the invention, the joint 9, shown in greater detail in FIG. 2, comprises a rigid framework 10 of flat bars substantially rectangular transverse or cross section, which encircles the assembly of anodes 5 and cathodes 8. The framework 10 is inserted in a flexible envelope 11 made with a U-shaped section, the central part of the U covering the surface 12 of the framework 10 which faces towards the interior of the cell and the two arms of the U covering respectively the upper surface 13 and the lower surface 14 of the framework. These two arms of the envelope 11 are thus inserted and clamped between the rigid framework 10 and the two walls 2 and 3.

The flexible envelope 11 is made of a material which is electrically non-conducting, resistant to corrosion and has a hardness on the Shore A Scale between substantially 2 and 20.

In the cell of FIGS. 1 and 2, the rigid framework 10 is preferably a laminate of polyester and glass fibres, while the flexible envelope 11 is made of a cellular material, for example of cellular synthetic rubber. Advantageously the envelope comprises a copolymer of butadiene and propylene, for instance the synthetic rubber known under the trademark DUTRAL (Montecatini).

In the cell of FIG. 1, the joint 9, of large transverse section is capable of ensuring efficient sealing of the cell under the action of no more than the weight of the side wall 3 surmounted by the cover 4, which corresponds, for example, to a specific pressure of the order of 1–2 kg/cm$^2$.

In an advantageous form of the cell of FIGS. 1 and 2, the envelope 11 is extended by a strip 15, which reaches the exterior of the cell, up to or beyond the edge 16 of the base plate 2. The strip 15 thus covers the marginal area of the metal plate 2 and prevents the establishment of a parasitic current between plate 2 and the side wall 3 in the event that electrically conducting articles, for example material used in maintenance work on the cell, occasionally come in to contact with the external surface of the side wall 3.

In a modified embodiment (not shown) of the cell described above the flexible envelope 11 is made of three separate strips covering respectively the three faces 12, 13 and 14 of the framework 10 and welded or stuck together.

Also, in the cell according to the invention, the framework 10 and/or the flexible envelope 11 may have a transverse section which is different from that described above with reference to FIGS. 1 and 2.

Although, in the preceding description, the invention has been applied particularly to the case of a cell wherein the base wall (baseplate) is made of metal, it will be apparent that the invention is equally applicable to the case where the base wall is made of another material, for example concrete.

It will also be apparent that the joint 17, which ensures sealing between the side wall 3 and the cover 4 of the cell, may likewise be made in similar manner to the joint 9.

What we claim is:

1. A cell for the electrolysis of an aqueous solution of alkali metal halide, comprising, a bottom wall, an alternating sequence of substantially vertical and parallel anodes and cathodes supported by said bottom wall, peripheral sidewalls supported on the said base wall enclosing said cathodes and anodes, a sealing joint on which said peripheral sidewalls wall rests, the sealing joint comprising a framework which surrounds the anodes and cathodes made of flat, rigid bars, an envelope in which said framework is inserted and made of a material which is resistant to corrosion and has a hardness of the Shore A Scale between substantially 2 and 20, said envelope covering at least that part of the bars of the framework that face towards the interior of the cell and disposed between the framework and said peripheral sidewalls and bottom wall.

2. A cell according to claim 1, wherein the bars of the framework are made of a corrosion-resistant material and the envelope is made of a cellular material.

3. A cell according to claim 1, wherein the bars of the framework are made of a reinforced polyester.

4. A cell according to claim 3, wherein the bars of said framework are a laminate of polyester and glass fibres.

5. A cell according to claim 1, wherein the envelope is made of an electrically non-conductive material.

6. A cell according to claim 5, wherein the envelope is made of synthetic rubber.

7. A cell according to claim 6, wherein the envelope comprises a copolymer of butadiene propylene.

8. A cell according to claim 1, wherein the flat bars of said framework have a substantially rectangular cross section and the envelope comprises a section of U-shape, the central part of the U covering the surface of the framework that faces towards the interior of the cell, and the two arms of the U being inserted between the framework and the peripheral sidewalls and bottom wall respectively.

9. A cell according to claim 1, wherein the part of the envelope that is inserted between the framework and the base wall is extended by a strip which reaches the exterior of the cell, at least to the edge of the base wall.

10. A cell according to claim 1, which is a diaphragm cell for the manufacture of chlorine by the electrolysis of an aqueous solution of sodium chloride.

* * * * *